US005185069A

United States Patent [19]

Ford et al.

[11] Patent Number: 5,185,069

[45] Date of Patent: Feb. 9, 1993

[54] LIQUID METAL CATHODE ELECTROCHEMICAL CELL AND CATHODE FRAME

[75] Inventors: James M. Ford; David W. Cawlfield; Kenneth E. Woodard, Jr., all of Cleveland, Tenn.

[73] Assignee: Olin Corporation, Cheshire, Conn.

[21] Appl. No.: 776,016

[22] Filed: Oct. 15, 1991

[51] Int. Cl.[5] ..... C25B 9/00; C25B 15/08

[52] U.S. Cl. ..... 204/251; 204/279

[58] Field of Search ..... 204/251, 220, 219, 250, 204/279

[56] References Cited

U.S. PATENT DOCUMENTS

| | | | |
|---|---|---|---|
| 727,025 | 5/1903 | Tafel | 204/101 |
| 2,242,477 | 5/1941 | Osswald et al. | 204/101 |
| 2,749,301 | 6/1956 | Rosenbloom | 204/251 |
| 4,101,407 | 7/1978 | Hilaire et al. | 204/251 |
| 4,556,470 | 12/1985 | Samejima et al. | 204/251 X |
| 4,586,994 | 5/1986 | Samejima et al. | 204/251 X |
| 4,596,639 | 6/1986 | Nishio et al. | 204/251 X |
| 4,849,073 | 7/1989 | Dotson et al. | 204/101 |

OTHER PUBLICATIONS

Article entitled "Hydroxylamine Production by Electroreduction of Nitric Oxide in a Trickle Bed"—The Canadian Journal of Chemical Engineering, vol. 57, Oct., 1979.

*Primary Examiner*—Donald R. Valentine

*Attorney, Agent, or Firm*—Ralph D'Alessandro; F. A. Iskander

[57] ABSTRACT

A particular side frame design for use in an electrochemical cell with a catholyte flow pattern is disclosed wherein the cell can be generally horizontal or angled slightly from the horizontal and the catholyte is fed through a transition area into a gap in the catholyte compartment between the liquid metal cathode and the membrane on a first end and exits the gap on an opposing second outlet end. The side frame has opposing sides that are obliquely and downwardly angled in the corners to support the membrane in a wrinkle free manner so that the membrane is obliquely positioned between the liquid metal cathode and the anode. The membrane is above the level of the catholyte where the catholyte enters and exits the catholyte compartment, but drops to a level below the entry and exit points.

35 Claims, 3 Drawing Sheets

LIQUID METAL CATHODE ELECTROCHEMICAL CELL AND CATHODE FRAME

BACKGROUND OF THE INVENTION

The U.S. Government has rights in this invention pursuant to Contract No. DAAA 15-89C-0011 awarded by the Department of Army. Under this contract, the U.S. Government has certain rights to practice or have practiced on its behalf the invention claimed herein without payment of royalties.

The present invention relates to an electrochemical cell for use in the production of aqueous solutions of inorganic chemicals and preferably hydroxylamine compounds. More particularly, the present invention relates to the design of the cathode and mating anode side frame and the particular complex curvature employed adjacent the cathode end boxes in the electrochemical cell which may be used in the production of aqueous solutions of hydroxylamine nitrate and other inorganic or organic chemicals using electrochemical reduction at a liquid metal surface.

Hydroxylamine nitrate is employed in the purification of plutonium metal, as one component of a liquid propellant, and as a reducing agent in photographic applications. In some of these applications a highly pure form of the compound is required.

Previous electrolytic processes have electrolyzed nitric acid solutions containing mineral acids such as sulfuric acid or hydrochloric acid to form hydroxylamine salts of these acids. The processes were carried out in an electrolytic cell having high hydrogen overvoltage cathodes, such as mercury or an alkali metal amalgam, with a diaphragm or membrane separating the cathode from the anode.

The hydroxylamine salt produced by the electrolytic processes of the prior art can be converted to hydroxylamine nitrate at low solution strength and in an impure state. One method is by electrodialysis as taught by Y. Chang and H. P. Gregor in Ind. Eng. Chem. Process Des. Dev. 20, 361-366 (1981). The double displacement reaction employed requires an electrochemical cell having a plurality of compartments and requiring both anion exchange and cation exchange membranes or bipolar membranes with significant capital costs and high energy costs.

U.S. Pat. No. 4,849,073 issued Jul. 18, 1989 and is assigned to the assignee of the present invention disclosed a process and electrochemical cell to directly produce a concentrated hydroxylamine nitrate solution. A mercury cathode was used on top of a conductive plate that was also the top of the cooling compartment. This design entailed the use of additional space for the separate cooling compartment and did not provide for high circulating catholyte flow rates or against the possible loss of the mercury cathode from the cell.

Electrolytic cell designs using liquid mercury cathodes have long been employed to produce chlorine and caustic in what are known as chlor-alkali cells. In these chlor-alkali cells the mercury amalgam is removed from the cells to make the product caustic by a secondary reaction in what is known as a n"decomposer". The gap between the anode and the liquid mercury cathode is kept small to minimize voltage requirements during electrolysis. Occasional contact of the mercury with the anode, although undesirable, can occur.

Where membranes are used in the electrolytic cell, it is essential that wrinkling be avoided and a liquid-tight seal be obtained between the membrane and the anode and cathode structure. Further, where the flowable liquid metal cathode is employed, the design must ensure that the liquid metal cathode does not contact the membrane. Such contact may cause holes to be created in the membrane by electrical shorting, as well as possibly affecting the electrode reactions.

These and other problems are solved by the design of the present invention whereby a generally horizontal electrochemical cell is provided with differential pressure that holds the membrane in place against the anode. The sides of the cathode and anode frames are obliquely angled toward the ends adjacent the catholyte inlet and outlet passages to support the membrane through a compound curve in relation to the inlet and outlet passages of the cathode endboxes.

SUMMARY OF THE INVENTION

It is an object of the present invention to provide an electrolytic cell with a sufficiently large volumetric capacity inlet area to receive a large volume of force circulated catholyte and pass it into the relatively narrow gap between the membrane and the flowable liquid metal cathode.

It is another object of the present invention to provide a side frame design that supports the membrane so that the membrane lies obliquely angled along the opposing sides of the frame and toward the opposing ends to position it with a major portion in an extended plane across the generally horizontal cell while the electrochemical reduction of the chemical in the catholyte on the liquid metal cathode occurs.

It is still another object of the present invention to provide a side frame design that permits the membrane to be sealed between the anode and the cathode compartments in a liquid-tight and substantially wrinkle-free manner.

It is a feature of the present invention that the cathode frame has obliquely and downwardly angled portions adjacent the corners on the two opposing sides of the frame toward the ends adjacent the inlet and outlet catholyte passages to support the membrane above the flowable liquid metal cathode in multiple level positioning so that the membrane is raised above the level of the entering and exiting catholyte at opposing ends of the catholyte compartment and then is angled downwardly to a position below the catholyte entrance and exit portions on the generally extended plane of the major portion of the membrane.

It is a further feature of the present invention that the obliquely and downwardly angled portions of the two opposing side frames of the electrolytic cell in the cathode compartment permit the catholyte flow pattern to both enter the cell at the first inlet end and leave the cell at the second outlet end at a level above the extended plane of the major portion of the membrane.

It is still another feature of the present invention that the obliquely and downwardly angled portions of the two opposing side frames causes the catholyte to flow below the level of the extended plane of the major portion of the membrane as the catholyte enters and exits the cell while, in combination with the differential pressure, providing sufficient support to hold the membrane in place abov the gap above the cathode.

It is yet another feature of the present invention that the complex curvature of the opposing side frames creates a transition area of increased cross-sectional area that permits a large volume of liquid to be taken from a plurality of inlet orifices and directed at a controlled velocity into the small gap between the membrane and the flowable liquid metal cathode.

It is still another feature of the present invention that the top surfaces of the opposing sides have compound curves on the ends of the obliquely angled and downwardly angled portions.

It is yet another feature of the present invention that the compound curves on the top surfaces of the opposing sides on opposing ends of the obliquely and downwardly angled portions provide smoothly curved transitions to the opposing sides which support the membrane in a bilevel configuration.

It is an advantage of the present invention that the membrane is retained in place between the anode and the flowable liquid metal cathode by the oblique angles of the frame opposing sides to avoid compound wrinkling and sharp bends in the membrane.

It is another advantage of the present invention that a large volume of catholyte flows across the catholyte compartment in the small gap between the liquid metal cathode and the membrane to maintain the cell at the desired operating temperature without the need for internal cooling apparatus and to minimize catholyte temperature rise across the length of the cell.

It is a further advantage of the present invention that the catholyte flow rate is sufficiently great to help clear any gas bubbles generated by the electrolytic reaction from the surface of the membrane.

These and other objects, features and advantages are provided in the design of the opposing sides of cathode frames and mating anode side frames of a generally horizontal electrolytic cell that have top surfaces that are obliquely and downwardly angled from the horizontal adjacent the corners of the frame so that the membrane has a major portion positioned generally through an extended plane to define a gap between a liquid metal cathode and the membrane so that the catholyte is fed into the gap on a first inlet end and exits the gap on an opposing second outlet end such that the catholyte enters and leaves the gap above the level of the major portion of the membrane that is positioned in the extended plane.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
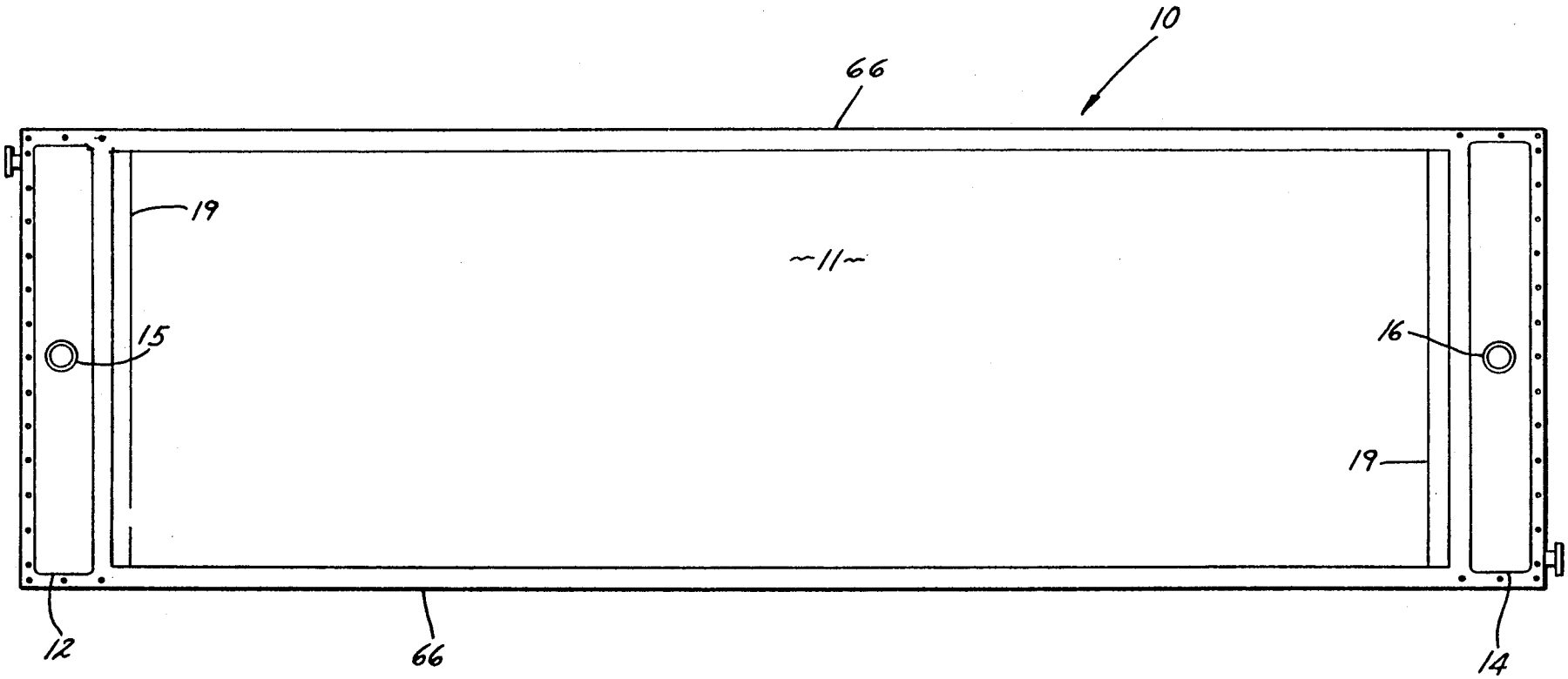
FIG. 1 is a plan view of the catholyte chamber of the electrochemical cell of the instant invention showing the catholyte end boxes on opposing ends of the cell.

FIG. 1 shows the cell bottom 11 of the electrolytic cell 10 used to produce desired chemicals employing an electrochemical reduction at the surface of a flowable liquid metal cathode. As seen in FIG. 1, the cathode inlet end box 12 and the cathode outlet end box 14 are shown in the lengthwise configuration of cell with a catholyte inlet feed pipe or header 15 and a catholyte outlet pipe or header 16 shown exiting their respective end boxes.

Figure 2:
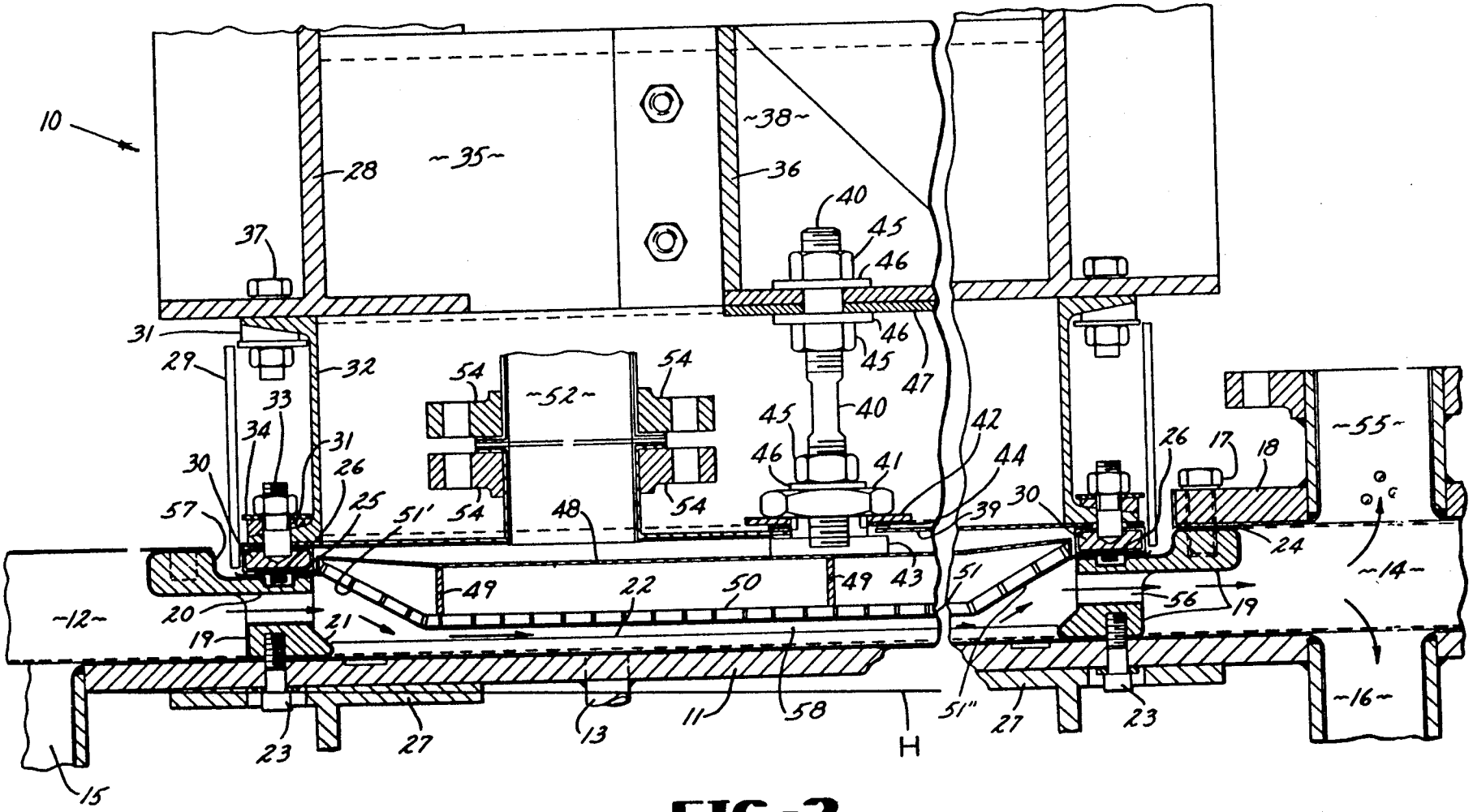
FIG. 2 is a side sectional elevational view of the cells showing the catholyte flow pattern from the inlet side through the outlet side of the cell.

The sectional view through the cell shown in side elevational fashion in FIG. 2 illustrates the catholyte flow pattern. As seen in FIG. 2 the catholyte enters and exits the catholyte compartment in the cell 10 at a level above the major portion of the membrane 51. The membrane 51 is positioned across an extended plane between the first lower inlet end passages 20 and the opposing higher second outlet end passages 56, only one of each being shown in FIG. 2. Catholyte is fed into the cathode inlet end box 12 via an appropriate fitting, such as the catholyte inlet feed pipe 15 and passes through the cathode frame first end 19 via the lower first inlet end passage 20 into the gap 58 in the cathode compartment between the surface of the liquid metal cathode 22 and the cation permselective membrane 51. The gap 58 between the membrane 51 and the surface of the liquid metal cathode 22 is between about 2 to about 20 millimeters, more preferably is about 6 to about 13 millimeters, and most preferably is between about 7 to about 11 millimeters. The membrane 51 is held against the woven wire screen mesh anode 50 by differential pressure. This differential pressure, which can vary from as little as about 0.1 to as much about 4.0 pounds per square inch, creates a generally uniform flow gap between the membrane 51 and the liquid metal cathode 22.

The anode can have a screen mesh welded to rods or members which can be made from tantalum or niobium. The mesh can be made from any noble metal or noble metal oxide coated on a substrate and, more preferably, a platinum clad niobium. Preferably the platinum is coextruded over a niobium wire.

A wide variety of cation exchange membranes can be employed containing a variety of polymer resins and functional groups, provided the membranes possess the requisite anion and gas selectivity, as well as preventing or minimizing the passage of excessive amounts of water from the anode compartment into the cathode compartment. Suitable cation exchange membranes are those which are inert, flexible, and are substantially impervious to the hydrodynamic flow of the electrolyte and the passage of any gas products produced in the anode compartment. Cation exchange membranes are well-known to contain fixed anionic groups that permit the intrusion and exchange of cations, and exclude anions, from an external source. Generally the resinous membrane or diaphragm has as a matrix a cross-linked polymer to which are attached charged radicals, such as $-SO_3^{=}$, $-COO^-$, $--PO_3^{=}$, $-HPO_2^{=}$, $-AsO_3^{=}$, and $-SeO_3-$ and mixtures thereof. The resins which can be used to produce the membranes include, for example, fluorocarbons, vinyl compounds, polyolefins, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid groups" are meant to include salts of sulfonic acid or salts of carboxylic acid groups formulated by processes such as hydrolysis. Suitable cation exchange membranes are sold commercially by E. I. Dupont de Nemours & Co., Inc. under the trademark "NAFION", by the Asahi Glass Co. under the trademark "FLEMION", and by the Asahi Chemical Co. under the trademark "ACIPLEX".

The major portion of the membrane that is stretched across an extended plane between the lower first inlet end passages 20 and the opposing higher second outlet end passages 56 is illustrated by the numeral 51, while the obliquely angled portions of the membrane supported against the anode woven mesh screen mesh 50 adjacent the end boxes 12 and 14 on opposing sides of the cell 10 are indicated as 51'.

As best seen in FIG. 2, the catholyte enters through the cathode frame first end 19 via the lower first inlet end passages 20 and flows across the surface of the liquid metal cathode 22 beneath the membrane portions 51', 51 and 51'' until it exits through the opposing higher outlet end passages 56. The flow rate of the catholyte across the liquid metal cathode is sufficient to maintain the temperature of the electrolytic cell 10 at a level to permit the product specific reactions to occur and to prevent product decomposition from occurring within the cell. The catholyte, upon leaving the cell 10 via the catholyte outlet 16 in end box 14, is circulated to a heat exchanger or chiller (not shown) to reduce the temperature to about 10° C. The flow rate of the catholyte required will depend upon the heat generated by the kiloampere current load at which the cell 10 is operated.

Further, the velocity of the catholyte increases in the area of the extended plane of the membrane 51. One of the challenges in scaling up from a laboratory scale production model to a commercial scale facility was the necessity to increase the length of the cell to have a longer flow path through the cell, but maintain the residence time of the electrolyte in the cell within the required limits even though the cell was longer. Also, the cross-sectional area in the transitional areas adjacent the obliquely angled portions 51' of the membrane 51 must be sufficient, on the inlet end, to receive the large volume of catholyte from the inlet passages 20 and pass it into the narrow catholyte compartment gap 58 between the major portion of the membrane 51 in the extended plane and the liquid metal cathode 22, seen in FIG. 2. The cross-sectional area in the transitional area adjacent the obliquely angled portion 51'' as well must receive the high velocity catholyte flow as it leaves the gap 58 on the outlet end and exits the catholyte chamber via the outlet passages 56.

Figure 3:
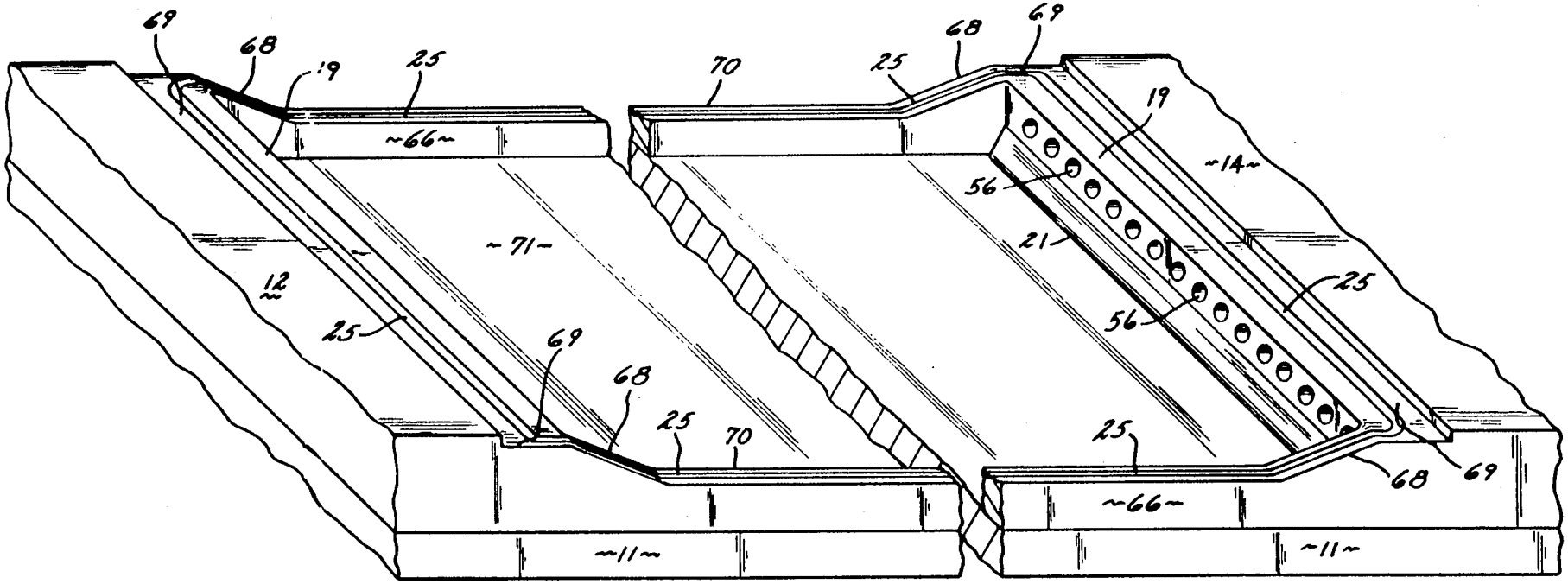
FIG. 3 is a side perspective view of the catholyte compartment with the cell top, anode, gaskets and the liquid metal cathode removed showing the opposing sides of the cathode side frame, the ends of the cathode frame, the cell bottom and having a portion of the catholyte compartment broken away and removed.

As seen in FIGS. 1 and 3, the cathode frame has opposing first and second sides 66 and opposing ends 19. Adjacent each corner of the cathode frame opposing side 66 has an obliquely and downwardly angled portion 68, best seen in FIG. 3, that connects the upper portion 69 and the lower portion 70. The upper portion 69 is at the same height or level as the cathode frame ends 19. The top surface of the opposing sides 66 has the O-ring groove 25 machined therein to receive the sealing O-ring 26 of FIG. 2. These obliquely and downwardly angled portions 68 on the two opposing sides of the cathode frame permit the membrane to be positioned so that the portions of the membrane adjacent the cathode end boxes 12 and 14 are at a higher level above the level of the entering and exiting catholyte with respect to the catholyte compartment 71 of FIG. 3 and the catholyte compartment gap 58 of FIG. 2. This complex curvature of the top surfaces of the opposing sides 66 of the cathode frame running from the upper portion 69 down the obliquely and downwardly angled portion 68 to the lower portion 70 permits the membrane of FIG. 2 to be obliquely positioned wrinkle-free and in contact with the correspondingly angled anode 50. Also, this complex curvature permits a large volume of catholyte to pass through the catholyte inlet passages 20 and the catholyte outlet end passages 56 in a cell operating under pressure without having the flow passages to yield or distort and thereby destroy the liquid tight seal.

As seen in FIGS. 2 and 3, the opposing sides 66 of the cell frame support the membrane in a multiple level configuration so that on its upper level the membrane is supported by the upper portions 69 of the opposing sides 66 and the cathode frame ends 19. On its lower level the membrane is in the extended plane of the major portion of the membrane 51. This major portion of the membrane 51 is the central portion of the reduced interelectrode gap where the main electrolysis in the cell 10 occurs. The major portion of the membrane 51 is supported by the top surfaces of the lower portions 70 of the opposing sides 66.

The interelectrode gap is widest at the entrance and exit areas of the catholyte chamber where the obliquely angled portions of the membrane 51' and 51'' are supported by the top surfaces of the obliquely and downwardly angled portions 68 of the opposing sides 66. These entrance and exit areas are configured by the design of the transition shapes in the top surfaces of the cathode frame opposing sides 66 and the bottom surfaces of the mating anode frame opposing sides (not shown). These transition shapes provide the straight central surfaces adjacent the area where the main electrolysis occurs and the obliquely angled surfaces adjacent the entrance and exit areas.

The surfaces of the obliquely and downwardly angled portions 68, as well as the mating anode frame portions (not shown) have lead-in and lead-out curves immediately adjacent and on opposing sides of the obliquely angled sections. These curves can have radii of about 5 to about 125 millimeters, preferably from about 25 to about 78 millimeters, and more preferably from about 25 to about 42 millimeters.

The central open area of the electrode in the catholyte compartment 71 of FIG. 3 above the cell bottom 11 terminates at each end 19 in the frame dam toe portion 21. Opposing ends 19 have multiple orifices or passages 20 and 56 that exit from and lead into the inlet end box 12 and the outlet end box 14, respectively. Phase separation occurs in the outlet end box 14. The multiple passages 20 and 56 are configured to provide strong arched support to the cell frame.

The O-ring gasket 26 of FIG. 2 fits within the groove 25, best seen in FIG. 3, about the entire periphery of the top surface of the cathode frame on opposing sides 66 and ends 19. The mating anode frame is similarly constructed so that a liquid-tight seal is effected between the anode and cathode frames and their gaskets when the membrane is positioned intermediately therebetween.

In the instant design, it is critical that the force of the catholyte flowing through the cell directed toward the outlet end passages 56 of the cell is exactly counterbalanced by the force of the liquid metal directed toward the inlet end passages 20 of the cell 10 and is proportional to the difference in height between the exit and the inlet ends of the cell and the density of the liquid metal cathod As seen in FIG. 2, the cell 10 is angled from the horizontal, which is indicated generally by the line designated H. The tilting of the entire cell, in combination with the catholyte flow rate, permits the liquid metal cathode to remain at a generally static level in the catholyte chamber and maintain the surface of the major portion of the membrane and the surface of the liquid metal cathode as generally parallel. Since the angle or tilt of the cell 10 and the flow rate of the catholyte through the gap 58 between the membrane and the liquid metal cathode 22 are interrelated, one or both may have to be adjusted to maintain the parallel relationship of the surface of the liquid metal cathode 22 and the membrane portion 51. This particular configuration and flow velocity of the catholyte also permit any gas bubbles generated during electrolysis to be carried by the channel flow pattern from the inlet end passage 20 and through the outlet end passage 56 into the outlet end box 14 of the cell.

It is theorized that the flow pattern and velocity of the catholyte through the gap 58 creates an almost circular flow pattern within the liquid metal cathode 22 that causes the top surface of the liquid metal cathode 22 to move from the inlet end passage 20 toward the outlet end passage 56 because of the drag created on the top layer of the liquid metal cathode 22 while the bottom of the liquid metal cathode 22 moves in the opposite direction, flowing down the angled cell bottom 11 toward the inlet end passage 20. The catholyte is force flow circulated through the gap 58 in the catholyte compartment in the cell 10 at a flow rate of between about 75 to about 150 gallons per minute which produces a catholyte flow rate through the gap 58 of between about 1 to about 5 cubic meters per hour per square meter of cathode surface area and an average bulk flow velocity of about 0.1 to about 2 meter per second squared. This creates a flow with a Reynolds number between about 2000 and about 4000, which borders on turbulent flow.

This flow rate produces a flow pattern in the liquid metal cathode in which there are small waves that are choppy and move in multiple directions within the catholyte compartment, but no liquid metal is entrained in the outlet end passage 56. This is in contrast to a fully turbulent flow pattern where the waves of the liquid metal would be carried out and exit through the side frame 19 by the turbulent flow of catholyte. The high catholyte flow rate permits the omission of a space-consuming and costly cooling chamber or plate within the cell 10 and still permits the cell 10 to be operated with the catholyte maintained at a temperature of less than about 50° C.

Returning now to FIG. 2, it is seen that the catholyte end box 12 has a cover plate 18 that is retained in place by the retaining bolt 17. The cathode frame has an upper portion that has machined therein a groove 25 in which is placed a gasket, such as O-ring 26, to accomplish sealing against the anode end frame member 30. A gasket 24 is placed between the end box cover 18 and the upper end frame portion 57 of cathode frame first ends 19. The lower portion of the first ends 19 are retained in place against the cell bottom 11 by frame cap screw 23. Cap screw 23 passes through a bottom frame support 27 to the cell bottom 11.

The obliquely angled or sloped side frame dam or toe portion 21 of the cathode frame end sides 19 helps to retain the liquid metal cathode 22 in place and, in combination with the catholyte flow pattern, prevents its flowing out through the lower first inlet end 20. The obliquely angled side frame dam or toe portion 21 is preferably inwardly angled, as shown in FIG. 2, but may also be outwardly angled. The oblique angle prevents the incursion of the corrosive acid catholyte into contact with the cell bottom 11 by ensuring that a layer of the liquid metal cathode 22 always coats the bottom 11 and overlaps part of the dam portion 21 of cathode frame first end 19. This oblique angle also helps to dampen any waves that may start to build-up in the surface of the liquid metal cathode 22 because of the flow rate of the catholyte that passes over its surface.

As previously indicated, the cell 10 is angled slightly from the horizontal over less than about a 5 percent grade, preferably less than about a 3 percent grade and most preferably about a 0.1 to about a 1% grade. The percent grade slope depends on the catholyte flow rate through the gap, with a higher flow rate employing a greater percent grade slope. The cell slope is adjusted by a plurality of adjustment bolts (not shown) across the cell bottom. The catholyte average bulk flow velocity inside the cell 10 the gap 58 between the liquid metal cathode 22 and the membrane 51 is preferably between about 0.1 to about 1 meter per second calculated by cross sectional area and measured as an average of the flow permitted across the length of the approximately 4 meter long cell. Preferably the cell is tilted at an angle that is equivalent to about an 11 millimeter rise over its 4 meter length. The catholyte flow thereby displaces the liquid metal in linear fashion by the uniform pressure drop of the flowing catholyte to obtain sufficient flow to clear any bubbles generated by the reaction off the membrane 51 and obtain the required mass transfer. The gas bubbles, if left to build up, can create blockage or gas blinding of the membrane. The flow rate is sufficient, however, to not create sufficiently high velocity jets that create turbulence in the liquid metal cathode and carry that liquid metal cathode out of the cell. Although described hereinafter as being a flowable mercury cathode with regard to the production of hydroxyl ammonium nitrate, it is to be understood that any type of flowable liquid metal cathode could be employed which has a high hydrogen overvoltage, including the use of such metals as bismith and indium and alloys thereof in the production of other end products.

As can be seen in FIG. 2, the anode end frame 30 is secured to a top clamping frame 32 via a frame retaining bolt 33 which employs a washer 34 and a beveled washer 31. The top clamping frame 32 sits atop the cell top 39, which is preferably formed of stainless steel with a conforming coating of a perfluorinated polymer, such as PFA. The top clamping frame 32 is connected to a support beam 35 which employs an anode post securing frame 28 and a plurality of support L beams 36 across the top. The support beam 35 is fastened to the top clamping frame 32 via a beam retaining bolt 37 that employs a beveled washer 31 and a suitably sized hexagonal nut. Support L beams 36 can have gussets 38 to add additional support to the structure atop of the cell top 39. Within the anode compartment, anode support cross members 49 can support an anode top 48 which can be connected to electrode lead-in posts 40 (only one of which is shown) that are connected to copper bus 47. The electrode lead-in post 40 passes through the support L beam 36 and is retained in place by washers 46 and hexagonal nuts 45. The lead-in post 40 connects to the cell top 39 via a retaining nut 41, a lug washer 42 and a gasket 44 to provide a liquid-tight seal that permits current to be electrically conducted through the lead-in post 40 and a conductor pad or boss 43 to the anode.

Once the catholyte has flowed through the gap between the liquid metal cathode 22 and the membrane extended plane portion 51, it exits the cell through the opposing higher second outlet end passages 56 into the cathode outlet end box 14. There any gas, such as hydrogen, which was generated and removed as bubbles from the surface of the membrane, exits through the catholyte end box gas pipe 55, while the catholyte exits through the catholyte outlet 16 and may be recirculated.

Any gas, such as oxygen, generated within the anode chamber exits through the anolyte gas nozzle 52 that is connected to the cell top 39. The gas nozzle 52 can employ flanges 54 to retain multiple sections of the nozzle or pipe together.

The cell 10 is clamped together by a stainless steel upper clamping frame 32 and a stainless steel bottom clamping frame with tie bolts (both not shown). The stainless steel conforming PFA coated anode side frames are sealed to the stainless steel conforming PFA coated cell top 39 via GORETEX ® gaskets and to the membrane via the use of EPDM O-ring gaskets placed in grove 25. The anode lead-in post 40 connects via conductor pad or boss 43 to the anode top 48. GORETEX ® gaskets 24 are placed above and below the stainless steel PFA coated cathode first ends 19 to seal the membrane and the HASTELLOY C alloy cell bottom 11. Gaskets may be used along the interior of the cathode first ends 19 to assist in sealing to the cell bottom 11. The cell bottom 11 may be separate or may be machined from the same material as the cathode frame to form a single integrated structure. The particular frame design enables the membrane to extend to the outside of the cell 10 so that if any leaks occur, they are apparent and do not occur internally without being observable to contaminate the anolyte and the catholyte.

Where hydroxylamine nitrate is the desired product to be produced, an aqueous solution of nitric acid is fed to the cathode compartment of the electrolytic cell 10. The aqueous solution may contain any concentration of $HNO_3$ which is suitable for electrolysis to produce hydroxylamine nitrate. Since nitric acid is a strong oxidizing agent, the catholyte solution in the cathode compartment should have a uniform or homogeneous concentration so that localized pH gradients can be controlled and high $NO_3$— levels do not lead to oxidation of the product. The catholyte solution is essentially free of other mineral acids, such as hydrochloric acid or sulfuric acid.

During electrolysis, the desired reactions at the cathode are thought to be as given in the following equations:

$$HNO_3 + 2H^+ + 2e^- \rightarrow HNO_2 + H_2O \quad (1)$$

$$HNO_2 + 4H^+ + 4e^- \rightarrow NH_2OH + H_2O \quad (2)$$

(1) and (2) being summarized by:

$$HNO_3 + 6H^+ + 6e^- \rightarrow NH_2OH + 2H_2O \quad (3)$$

The hydroxylamine ($NH_2OH$) produced is then protonated for stabilization with $HNO_3$ according to the equation:

$$HNO_3 + NH_2OH \rightarrow [NH_3OH]^+NO_3^- \quad (4)$$

While equations (3) and (4) are believed to indicate the stoichiometric amounts of nitric acid required to produce hydroxylamine nitrate during operation of the electrolytic process, an excess amount of nitric acid in the catholyte is maintained which is from about 0.1 to about 1.5, preferably from about 0.1 to about 0.8 and more preferably from about 0.2 to about 0.5 moles per liter.

In a preferred embodiment, the catholyte solution is continuously removed from and recirculated to the cathode compartment, following the supplemental addition of $HNO_3$ required to maintain the concentrations given above.

The catholyte solution temperature in the cathode chamber is maintained below about 50° C., for example, in the range of from about 5° to about 40° C., and preferably at from about 10° to about 25° C. If the temperature of the catholyte is above about 50° C. or if oxygen is present in the catholyte, the undesired formation of by-products such as nitrogen oxide, ammonia or nitrogen dioxide may occur, as represented by the equations:

$$NH_2OH \cdot HNO_3 \rightarrow 2NO + 2H_2O \quad (5a)$$

$$3NH_2OH \rightarrow NH_3 + N_2 + 3H_2O \quad (5b)$$

$$4NH_2OH \rightarrow 2NH_3 + N_2O + 3H_2O \quad (5c)$$

The evolution of significant amounts of hydrogen gas is not desired. A preferred way to avoid this is to control the cathode half-cell potential. Suitable cathode half-cell potentials are those at about or below the hydrogen overvoltage for the cathode employed, for example, half-cell potentials in the range of from about −0.5 to about −3 volts versus a standard calomel electrode. Preferred cathode half-cell potentials are those in the range of from about −0.8 to about −2, and more preferably from about −1 to about −1.5.

When using a mercury cathode at half-cell potentials above about 3 volts, hydroxylamine nitrate may be reduced to ammonium nitrate according to the equation:

$$NH_2OH + HNO_3 + 2H^+ + 2e \rightarrow NH_4^+ + NO_3^- + H_2O \quad (6)$$

The actual hydrogen overpotential of a cathode depends on many factors including current density, local pH gradient, temperature, the concentration gradients of the catholyte, and particularly in using mercury cathodes, on the degree of contamination of the mercury surface with metal impurities. Because of these various factors, and despite the fact that the generation of hydrogen also results in the production of $OH^-$ ions which can decompose hydroxylamine nitrate, some generation of hydrogen gas can be tolerated in the process of the present invention.

The anolyte is an aqueous mineral acid solution capable of supplying protons to the catholyte. Suitable mineral acids include nitric acid, hydrochloric acid, phosphoric acid, sulfuric acid, perchloric acid, boric acid, and mixtures thereof. Preferred as an anolyte is a nitric acid solution since it will not introduce undesired impurities into the catholyte. Where the purity of the hydroxylamine nitrate product is not critical, other acids such as hydr :hloric or sulfuric may be used as the anolyte, providing they do not introduce sufficient amounts of the anion into the catholyte solution to form the corresponding hydroxylamine salt. Concentrations of the acid in the anolyte are not critical and any suitable concentrations may be used. It is advantageous to maintain the concentration of the anolyte solution higher than the concentration of the nitric acid catholyte solution to prevent dilution of the catholyte with water. For example, it is desirable to maintain a ratio of the molar concentration of the anolyte to that of the excess nitric acid in the catholyte of at least 2 and preferably from about 6 to about 15. The anolyte is preferably continuously removed from and recirculated to the anode compartment with the concentration of the acid being adjusted as required.

The cell 10 of the present invention is operated at current densities suitable for producing concentrated solutions of hydroxylamine nitrate. For example, suitable cathode current densities include those in the range of from about 0.05 to about 10, preferably from about 0.2 to about 6, and most preferably from about 1 to about 4 kiloamperes per square meter.

Hydroxylamine nitrate solutions produced by the process of the present invention are of high purity. Hydroxylamine nitrate is however less stable than other hydroxylamine salts particularly at high temperatures. It is particularly important where the product solutions are to be concentrated, such as for example, where they use in a propellant, to carefully control the concentration of excess nitric acid in the product solution. This can be accomplished in one of several ways described in U.S. Pat. No. 4,849,073, assigned to the assignee of the present invention, and specifically incorporated by reference herein.

Materials of construction of the cell 10 are generally as described. The cell bottom 11 can employ Hastelloy C alloy, while other parts of the cell not previously specified can employ either steel or stainless steel 304 where the parts are not wetted and either coated steel or coated stainless steel 316 where they are wetted by fluids in the process. The coating should be a material that is not reactive with the process fluids, such as PFA, PVC or CPVC.

While the invention has been described above with reference to specific embodiments thereof, it is apparent that many changes, modifications and variations in the materials, arrangements of parts and steps can be made without departing from the inventive concept disclosed herein. For example, in employing the electrolytic cell design of the present invention, while the anolyte has previously been described as being circulated, it is not necessary to have the anolyte circulated as long as the concentration is periodically checked to ensure constant operating conditions. The anolyte need not be just an aqueous mineral acid, but could be any appropriate hydrogen ion containing electrolyte. Also, the process and cell disclosed herein can be used in any electrochemical process that requires the combination of reduction on a liquid metal cathode and an ion that is released at the anode and transported by the membrane into the catholyte where it is used in the reaction. Also, it may be possible to employ any other suitable type of a separator between the liquid metal cathode and the anode, including a diaphragm, in addition to the preferred membrane described herein. Lastly, it is to be understood that since mating anode and cathode frames are employed that a description of the top surface of the electrode frame is to be interpreted as each side frame having a continuous interior intermediate surface against which lies the membrane such that each interior surface is substantially coplanar with the membrane in the cell's assembled state. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A side frame for an electrolytic cell, the cell having a flowable liquid metal cathode in a catholyte compartment, an anode, an anolyte compartment, a membrane with a major portion thereof positioned in an extended plane between the anode and the cathode and a catholyte inlet and catholyte outlet for the flow of catholyte into and out of the catholyte compartment in the cell comprising in combination:

(a) an electrode frame with a pair of opposing ends having a first generally uniform height; and (b) a pair of opposing sides connected to the pair of opposing ends at a plurality of corners, each opposing side having an obliquely and downwardly angled portion extending from an upper portion adjacent each corner at the first generally uniform height to an extended lower portion at a second height that lies in a plane below the major portion of the membrane positioned in the extended plane, the obliquely and downwardly angled portion supporting the membrane in a obliquely angled position adjacent a gap between the anode and the cathode and being positioned only immediately adjacent each of the plurality of corners formed by the pairs of opposing ends and pair of opposing sides.

2. The side frame according to claim 1 further comprising the pair of opposing sides and the pair of opposing ends having a top surface.

3. The side frame according to claim 2 further comprising the top surface having a groove therein for receiving a gasket.

4. The side frame according to claim 3 further comprising the groove on the top surface having a gasket that extends about the opposing sides and the pair of opposing ends.

5. The side frame according to claim 2 further comprising each obliquely and downwardly angled portion having on opposing ends thereof a lead-in curve and a lead-out curve in the top surface to transition between the extended lower portion and the upper portion adjacent each corner.

6. The side frame according to claim 5 further comprising the lead-in curve and the lead-out curve having radii of between about 5 to about 125 millimeters.

7. The side frame according to claim 6 further comprising the lead-in curve and the lead-out curve having radii of between about 25 to about 78 millimeters.

8. The side frame according to claim 7 further comprising the lead-in curve and the lead-out curve having radii of between about 25 to about 42 millimeters.

9. The side frame according to claim 6 further comprising a cell bottom connected to the electrode frame defining a bottom of an electrolyte compartment.

10. The side frame according to claim 9 further comprising the electrode frame and the cell bottom being formed from a single piece of material.

11. The side frame according to claim 9 further comprising an outside surface and a membrane associated with the side frame such that the membrane extends to the outside surface of the side frame.

12. The side frame according to claim 9 further comprising a conforming coating of perfluorinated polymer thereabout.

13. The side frame according to claim 12 further comprising the perfluorinated polymer being formed from PFA.

14. The side frame according to claim 1 further comprising a first of the pair of opposing ends having a plurality of orifices for feeding catholyte through the inlet into a gap between the membrane and the flowable liquid metal cathode.

15. The side frame according to claim 14 further comprising a second of the pair of opposing ends having a plurality of outlet orifices for removing catholyte through the outlet from the gap.

16. The side frame according to claim 15 further wherein the membrane is held in place against the anode by differential pressure.

17. The side frame according to claim 16 further comprising the pair of opposing sides being lower in the central portion than the pair of opposing ends of the electrode frame.

18. A horizontal electrolytic cell having a liquid metal cathode in a catholyte compartment, an anode, a separator, a catholyte inlet and catholyte outlet for the flow of catholyte into and out of the catholyte compartment in the cell comprising:

at least two electrode frame each having a pair of opposing ends having a first generally uniform height and a pair of opposing sides meeting the opposing ends at a plurality of corners, each opposing side having an obliquely angled portion extending from each corner at the first generally uniform height slopingly to an extended portion at a different lower level, each frame having a continuous interior intermediate surface against which lies the membrane such that each interior intermediate surface is substantially coplanar with the membrane and the extended portion lies substantially coplanar with the major portion of the separator positioned in the extended plane, the obliquely and slopingly angled portion supporting the membrane in an obliquely angled relationship adjacent a gap between the anode and the cathode and being positioned only immediately adjacent each of the plurality of corners formed by the pair of opposing ends and pair of opposing sides.

19. The electrolytic cell according to claim 18 further comprising each interior intermediate surface having a groove therein for receiving a gasket.

20. The electrolytic cell according to claim 19 further comprising the groove on the interior intermediate surface having a gasket that extends about the opposing sides and the pair of opposing ends.

21. The electrolytic cell according to claim 20 further comprising each obliquely and slopingly angled portion having opposing ends, the opposing ends thereof having a lead-in curve and a lead-out curve in the interior intermediate surface to transition between the extended lower portion and the upper portion adjacent each corner.

22. The electrolytic cell according to claim 21 further comprising the lead-in curve and- the lead-out curve having radii of between about 5 to about 125 millimeters.

23. The electrolytic cell according to claim 22 further comprising the lead-in curve and the lead-out curve having radii of between about 25 to about 78 millimeters.

24. The electrolytic cell according to claim 23 further comprising the lead-in curve and the lead-out curve having radii of between about 25 to about 42 millimeters.

25. The electrolytic cell according to claim 21 further comprising a cell bottom connected to the electrode frame defining a bottom of an electrolyte compartment.

26. The electrolytic cell according to claim 25 further comprising the electrode frame and the cell bottom being formed from a single piece of material.

27. The electrolytic cell according to claim 25 further comprising the electrode frame having an outside surface and a membrane associated with the electrode frame such that the membrane extends to the outside surface of the electrode frame.

28. The electrolytic cell according to claim 25 further comprising the electrode frame having a conforming coating of perfluorinated polymer thereabout.

29. The electrolytic cell according to claim 28 further comprising the perfluorinated polymer being formed from PFA.

30. The electrolytic cell according to claim 18 further comprising the pair of opposing sides being lower in the central portion than the pair of opposing ends of the electrode frame.

31. The electrolytic cell according to claim 18 further comprising one of the electrode frames being a cathode frame.

32. The electrolytic cell according to claim 31 further comprising a first of the pair of opposing ends having a plurality of orifices for feeding catholyte through the inlet into a gap between the membrane and the flowable liquid metal cathode.

33. The electrolytic cell according to claim 32 further comprising a second of the pair of opposing ends having a plurality of outlet orifices for removing catholyte through the outlet from the gap.

34. The electrolytic cell according to claim 33 further comprising the membrane being held in place against the anode by differential pressure.

35. The electrolytic cell according to claim 18 further comprising one of the electrode frames being an anode frame.

* * * * *